US005080242A

United States Patent [19]

Steffen et al.

[11] Patent Number: 5,080,242

[45] Date of Patent: Jan. 14, 1992

[54] SLACKLESS RAILCAR CONNECTIONS WITH UPWARD WEAR INDICATOR

[75] Inventors: John J. Steffen, Darien, Ill.; Russell G. Altherr, Munster, Ind.

[73] Assignee: Amsted Industries Incorporated, Chicago, Ill.

[21] Appl. No.: 458,410

[22] Filed: Dec. 28, 1989

[51] Int. Cl.[5] ..... B61G 9/24

[52] U.S. Cl. ..... 213/62 R; 213/69; 213/75 R

[58] Field of Search ..... 213/50, 56, 58, 60, 213/75 R, 32 R, 62 R, 67 R, 69, 74

[56] References Cited

U.S. PATENT DOCUMENTS 373,957 11/1887 Young ..... 213/56
943,144 12/1909 Durbin ..... 213/67 R
1,443,716 1/1923 Pletcher ..... 213/69 X
1,925,319 9/1933 Goodall ..... 213/74
2,241,353 5/1941 Kinne et al. ..... 213/67 R
2,307,409 1/1943 Kinne et al. ..... 213/67 R
4,700,853 10/1987 Chadwick ..... 213/50 X
4,966,291 10/1990 Glover ..... 213/62 R X

*Primary Examiner*—Robert J. Oberleitner
*Assistant Examiner*—S. Joseph Morano
*Attorney, Agent, or Firm*—Edward J. Brosius; F. S. Gregorczyk

[57] ABSTRACT

A slackless railcar connection system includes a gravity wedge shim that has an extension means extending upwardly from the broad edge of the shim through an opening in a railcar center sill. A reference post may also be located adjacent the opening to visibly indicate the degree of wear of the wedge.

19 Claims, 3 Drawing Sheets

SLACKLESS RAILCAR CONNECTIONS WITH UPWARD WEAR INDICATOR

This invention relates to the art of railcar connections such as couplers, drawbars, articulated connectors and the like; and more specifically is directed to an improved slackless connection with a gravity wedge component that functions to move so as to fill up space created between other parts due to wear.

BACKGROUND OF THE INVENTION

Connectors for railcars are usually attached to each end of a car underside within the car center sill. A convex end of the connector normally rests against a follower block held within a sill pocket casting that is mounted within the sill to withstand forces tending to thrust the connector into the sill—e.g. compressive or buff loading. Additionally the connector is held against being withdrawn from the sill by a pin or draft key or by a collar which is spaced from the follower block. When the connector is first assembled to the car the clearances between the aforementioned parts are minimal and there is virtually no slack or movement of the parts longitudinal of the car when the forces on the connector are reversed as occurs each time the car is successively accelerated and decelerated. However, wear occurs through use causing spaces to be created between the parts. Such spaces are known as slack and the cumulative effect will be to repeat and magnify impact forces upon acceleration and deceleration. One cure for this problem has been to include a gravity wedge shim between two of the parts, usually between the follower block and the closed end of the sill pocket casting as shown in U.S. Pat. Nos. 3,716,146, 4,456,133, 4,549,666 and 4,593,829. Other examples of the use of wedges in railcar connections are U.S. Pat. Nos. 373,957, 1,443,716 and 1,925,319.

One or both of the adjacent surfaces of the follower block and/or the pocket casting are sloped to correspond to the wedge. The result is that as wear occurs between various connection parts the space will increase between follower block and pocket casting and the wedge will move downward by gravity to separate the adjacent parts sufficiently to take up the slack. However, at some point the wear may exceed the ability of the wedge to compensate and it must be replaced or augmented. But heretofore there has been no means, other than that disclosed in the copending U.S. patent application No. 07/351,066 of Kaim et al filed May 12, 1989, to visually gauge the extent of wear and anticipate the need for replacement.

Moreover when first assemblying such a railcar connection the gravity wedge must be manipulated upwardly to permit the other parts to be aligned. Also there are occasions when connectors must be disassembled from railcars to permit maintenance. At such times the wedge must be extracted from the adjacent parts to create sufficient slack to enable the parts to be removed from the sill. But heretofore this has required the insertion of tools through ports in the sill and/or pocket casting to engage and lift the wedge.

BRIEF SUMMARY OF THE INVENTION

Accordingly, it is a principal object of the present invention to provide a wedge shim for railcar connectors that overcomes one or more of the aforesaid problems.

It is another object of the present invention to provide a railcar connector gravity wedge shim that facilitates visual inspection and gauging of wear.

It is still another object of the present invention to provide a railcar connector gravity wedge shim wear indicator that is visible above a railcar sill.

It is a further object of the present invention to provide a slackless railcar connection with a visible gravity wedge shim that is externally supportable to facilitate assembly and extractable without the use of special tools.

Briefly stated the present invention involves the inclusion of at least one upward extension projecting from the broad edge of a gravity wedge and of sufficient length to extend to a point above the car sill through an opening therein. Preferably an apertured plate slidable upon the top of the sill closely receives the upward extension and covers the sill opening. The present invention is particularly suitable for railcars having exposed center sill ends.

BRIEF DESCRIPTION OF THE DRAWINGS

Other objects and advantages of the invention will become apparent upon reading the following detailed description in conjunction with the drawings wherein.

DETAILED DESCRIPTION OF THE INVENTION

Figure 1:
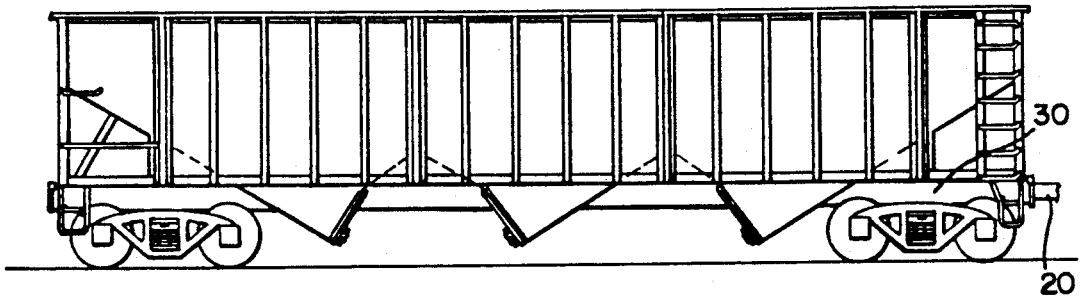
FIG. 1 is a side view of a typical railroad hopper car having exposed center sill ends suitable for the present invention.

The present invention is applicable to railcar connectors in which the portion of a car frame structure that receives a male end of a connecting member is accessible at the car end. Such railcars may have a connecting center sill portion that extends openly beyond the load container structure of the car such as the sloped bulkhead of a hopper car as illustrated in FIG. 1. The invention is also applicable to articulated car connectors such as shown in U.S. Pat. No. 3,716,146 and illustrated in FIG. 6 herein.

A basic embodiment of the present invention is shown in FIGS. 2–5. In the railcar connector system illustrated in FIG. 2 a drawbar end 20 having a curved butt end surfaces 24 is held in a railcar center sill 30 in conventional manner by a draft key 34, which extends through a slot 36 in the drawbar end 20 so as to engage a bearing block 38 within the slot 36 whereby to prevent outward longitudinal movement of the drawbar, and by a follower block 40 located in a sill pocket casting generally 42, which is secured against inward longitudinal movement by draft lugs (not shown).

Figure 2:
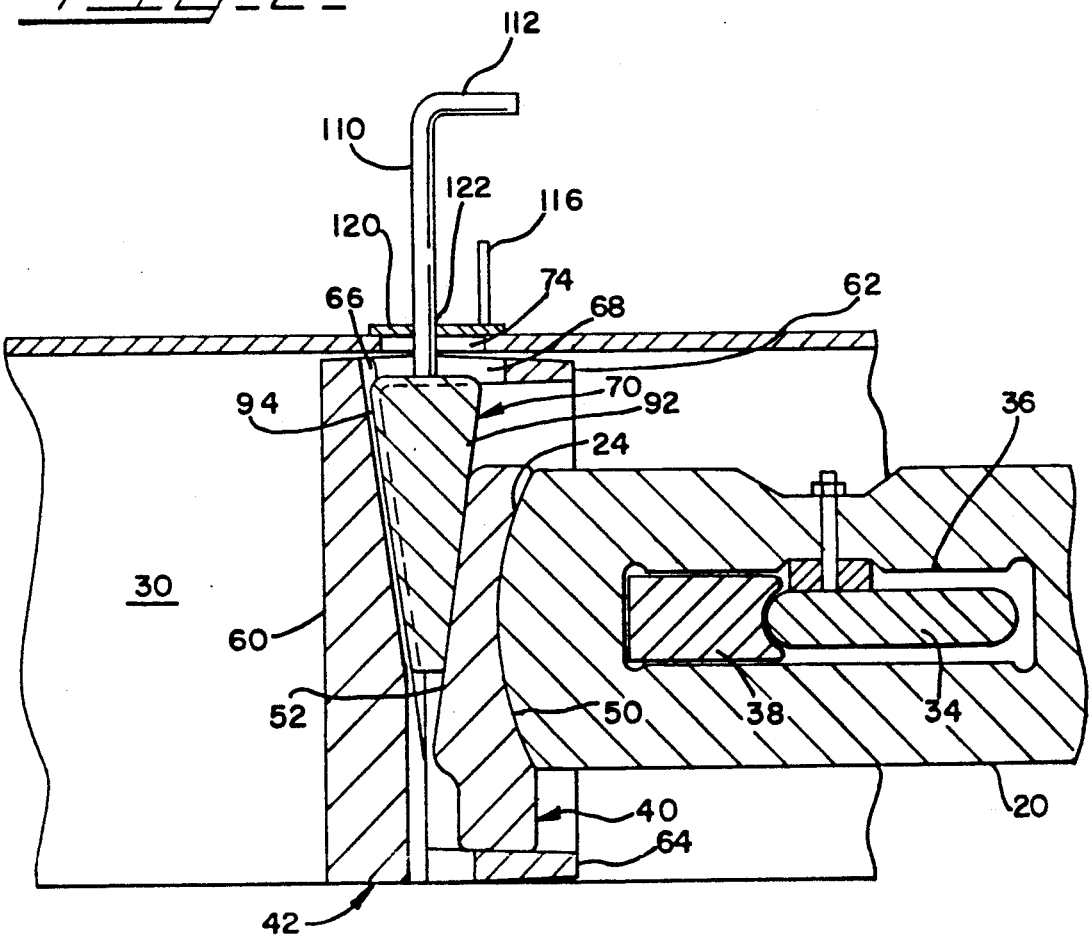
FIG. 2 is a sectional side elevation view of a slackless railcar connection with wedge shim according to the invention in a sill with a drawbar connector.

The follower block has a concave forward face 50, generally concentric with and receiving the drawbar butt end surface 24, and a sloped rear face 52. In turn the pocket casting comprises a vertical rear wall 60 and forwardly extending top and bottom walls 62, 64 and side walls (not shown) which peripherally encompass the follower block 40. As illustrated in FIG. 2, the rear wall 60 has an inner sloped surface 66 which is inclined opposite the sloped rear face 52 of the follower block 40 so as to receive a tapered wedge shim generally 70 therebetween. The pocket casting generally 42 has an upper port 68 in the top wall 62 and a corresponding opening 74 is provided in the top of the center sill.

The port 68 in pocket casting 42 and the opening 74 in the center sill top are centrally located and extend longitudinally, respecting the center sill, from points above the pocket casting rear wall 60 outwardly to points above the follower block 40 (when abutted against the drawbar 20). The port 68 and opening 74 may conveniently (but not necessarily) have a lateral dimension exceeding the breadth of the wedge shim 70.

Figure 5:
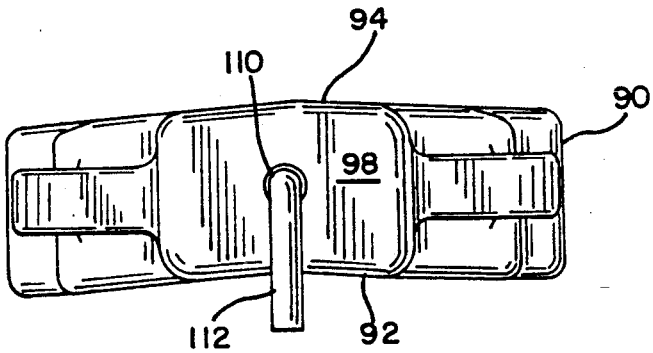
FIG. 5 is a top plan view of the wedge shim of FIG. 3.
Figure 3:
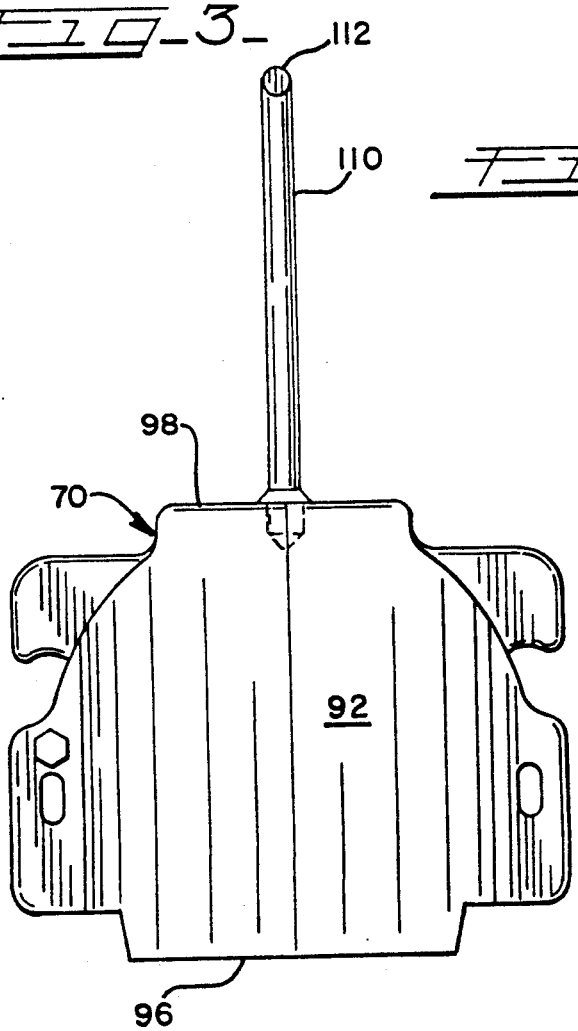
FIG. 3 is an elevation view of a wedge shim according to the present on and apart from a center sill.
Figure 4:
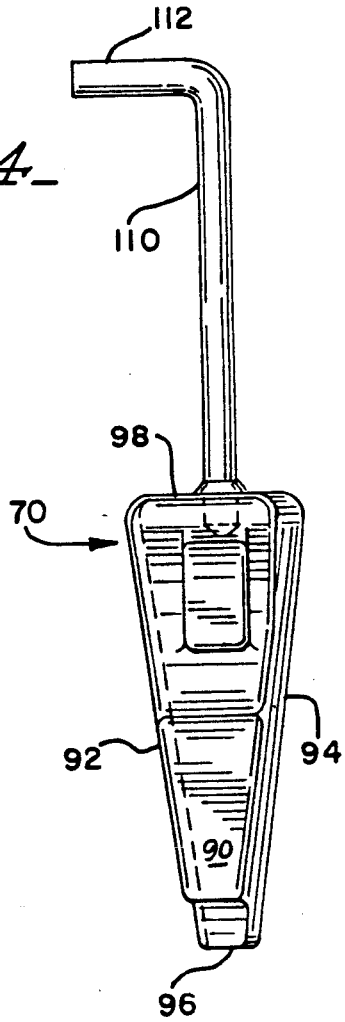
FIG. 4 is a detailed side elevation view of the wedge shim of FIG. 3.

In the embodiments illustrated the follower block sloped rear face 52 and the pocket casting sloped surface 66 may each be comprised of two portions slightly angled at vertical center lines so as to be somewhat convex and concave, respectively. Accordingly, the preferred wedge shim generally 70, as best seen in FIGS. 3–5, comprises a tapered wedge body 90 having front and rear faces 92, 94 diverging from a narrow bottom surface 96 toward a relatively broad top surface 98. As seen in FIG. 5 the wedge faces 92, 94 are chevron like in that each is comprised of angled portions so as to correspond to the convex and concave slopes of the follower block rear face 52 and pocket casting surface 66. The chevron-like wedge faces 92, 94 are known in the prior art to promote alignment with the pocket casting rear wall 60 and follower block 40. During railcar operation the wear may occur at the interface of the draft key 34, bearing block 38 and slot 36 and at wedge faces 92, 94 abutting follower block surface 52 and pocket rear wall surface 66, and the wedge 70 will gradually drop to compensate for the wear.

The present invention provides a visible indicator of the vertical position of the wedge shim generally 70 by including at least one upward extension means having a free upper terminus, such as rod 110, which extends from the broad wedge top surface 98 a sufficient length so that the free terminus protrudes through the port 68 in pocket casting 42 and the opening 74 in the top of the center sill 30. When it becomes necessary to disassemble the parts, the wedge shim 70 may be extracted from between pocket casting rear wall 60 and follower block 40 by lifting upwardly on the extension means namely the rod 110 which is secured by welding or threading or the like to the wedge body 90. To facilitate griping the rod 110 it is preferably provided with a terminus bend 112 (or a knob or eyelet or the like). It is essential that the wedge 70 be free to move vertically and longitudinally as the adjacent parts permit through wear; and therefore the extension means must be free and unsecured above the wedge body 90.

It is desirable to locate bend 112 (or similar terminus) at a distance above the wedge top surface 98 sufficient to remain protruding a short increment above the center sill when the wedge 70 has dropped to a point that replacement is recommended. Preferably a reference post 116 is positioned above the top of sill 30 adjacent the opening 74 close to the rod 110 so as to provide a visual bench mark against the rod. The height of the reference post 116 should be about equal to the aforementioned increment and thereby cooperate with the terminus on the rod 110 (such as bend 112) to indicate both actual wear and recommended replacement point. An advantage of this arrangement is that the wedge extension means and wear bench mark are easily inspected from car side or car end without any need to stoop under a car or stand between coupled cars.

It is also preferable to place a slidable cover plate 120 over the opening 74 in the top of sill 30. The dimensions of the cover plate 120 should slightly exceed the lateral dimension of opening 74 and substantially exceed the longitudinal dimension thereof; and the cover plate 120 has an aperture 122 that closely corresponds to the cross section of the wedge extension means (rod 110) to reciprocally receive the extension means. Cover plate 120 functions to prevent debris from falling through opening 74 and is movable longitudinally should the relative position of the wedge 70 change as it drops during the course of wear. The reference post 116 may conveniently be fastened to the upper surface of cover plate 120 as shown in FIG. 2 or it may be secured, as by welding or the like, directly to the top surface of the sill structure as shown in the articulated connection embodiment of FIG. 6.

It is to be understood that the wedge extension means may be located centrally of the wedge 70 and take the form of a cylindrical rod 110 as illustrated in the drawings. However, such extension means may be located eccentrically and may comprise shapes and cross sections other than shown herein. Furthermore the system of follower block, wedge and pocket casting parts may be otherwise designed to employ non symmetrical sloped surfaces or a sloped surface on only one of the follower block and pocket rear wall. Similarly such a system of parts employing the present invention may be adapted to a variety of railcar connectors such as couplers and articulated couplings as well as the drawbar illustrated in FIG. 2.

Figure 6:
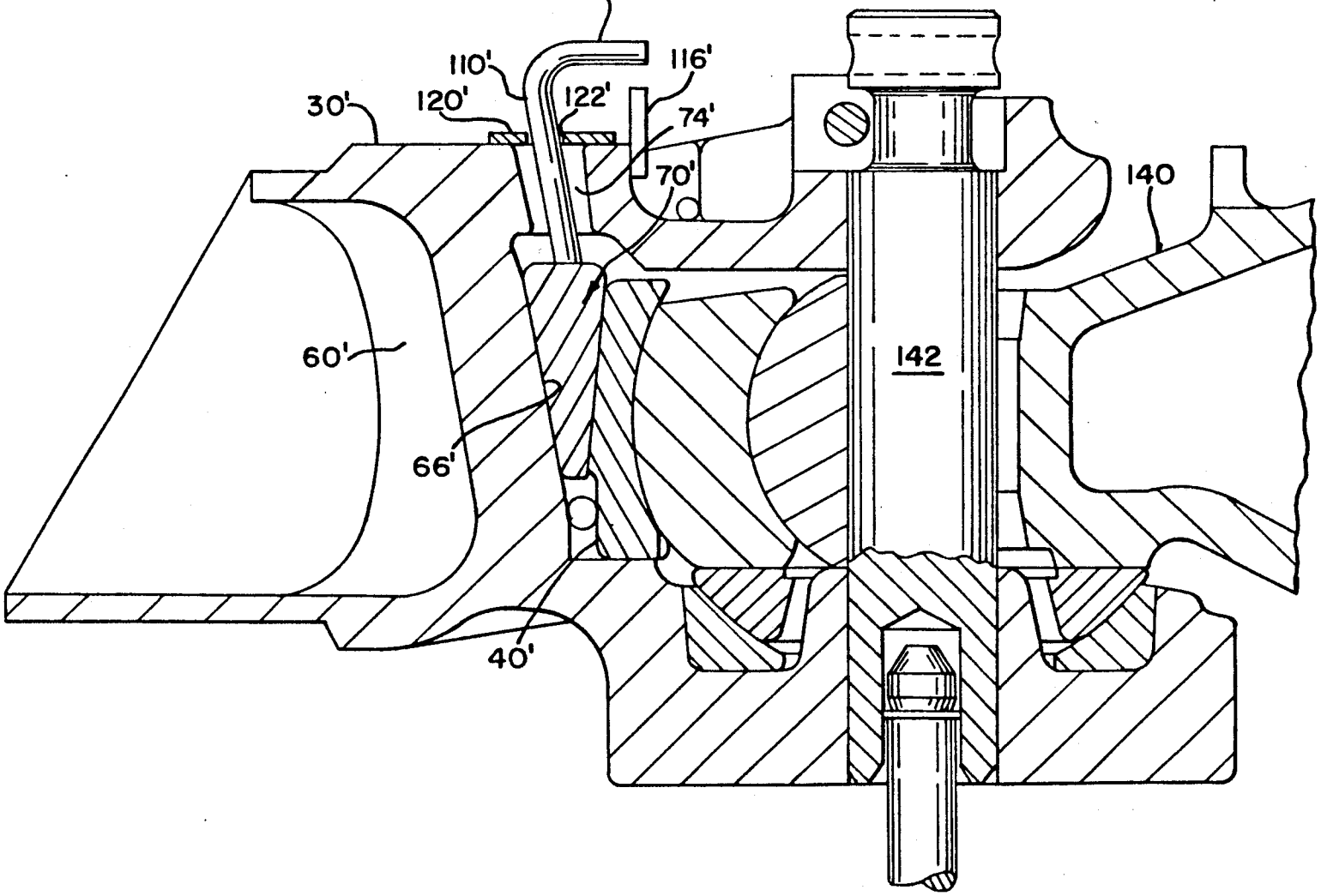
FIG. 6 is a sectional side elevation view of an articulated connector embodiment with a wedge shim of the present invention.

As a further example, an articulated car connection is shown in FIG. 6 wherein parts corresponding to those previously described are denoted with the same reference number bearing a prime notation. Thus a female stub sill 30' includes an integral pocket rear wall 60' with a sloped surface 66'. The stub sill 30' receives the male end 140 of a connector which is pivotable about a vertical pin 142 to take draft loads and which abuts a follower block 40' that transmits buff loads across a gravity wedge 70' to the rear wall 60'. In this embodiment the wedge extension means is in the form of a centrally located rod 110' that angles upwardly through an opening 74' and apertured cover plate 120'. Reference post 116' is fastened directly to the stub sill top surface near the hole 74'.

Further modifications and variations may be made in the aforedescribed invention without departing from the spirit and scope thereof which is defined hereafter in the claims.

What is claimed is:

1. An improved slackless railcar connection wherein a gravity fed wedge, that functions to move to fill space created due to wear, is positioned fully within a car sill, which wedge has an upper broad edge and a narrow edge pointing downward between a car sill pocket rear wall and a follower block engaged by a pivotable connector received in the car sill, said improvement comprising:

an opening in said car sill forward of said pocket rear wall and above said wedge; and an extension means for visually indicating wear of the wedge secured to the upper broad edge of said wedge, said extension means being of a length extending freely upwardly through said opening a distance above said car sill.

2. The structure of claim 1 including an apertured plate slidlingly resting upon said car sill over said opening said apertured plate reciprocally receiving said extension means therethrough.

3. The structure of claim 1 wherein said extension means is a rod secured to the center of said broad edge.

4. The structure of claim 1 including a reference post on said car sill adjacent said opening therein.

5. The structure of claim 2 including a reference post fastened upon said apertured plate.

6. The structure of claim 3 including a terminus end of said rod at a distance above said wedge in excess of the permissible wedge operating drop between said sill-pocket-rear wall and said follower block.

7. The structure of claim 6 wherein said terminus end is in the form of a bend.

8. The structure of claim 4 including a terminus end of said rod at a distance above said wedge in excess of the permissible wedge operating drop between said sill-pocket-rear wall and said follower block.

9. An improved gravity wedge for vertical movement between a follower block and sill pocket rear wall in a slackless railcar connection, said wedge of a size to fit within a sill having a broad upper surface and a narrower lower surface and front and rear bearing surfaces between said upper and lower surfaces, and an extension means for visually indicating wear of the wedge secured to said broad upper surface.

10. The article of claim 9 wherein said extension means is secured centrally of said upper surface.

11. The article of claim 10 wherein said extension means is a rod.

12. The article of claim 11 wherein said rod terminates in the form of a bend spaced from said upper surface.

13. The article as claimed in claim 11 including a cover late having an aperture, said rod extending through and reciprocal in said aperture.

14. The article of claim 13 including a reference post secured to an upper surface of said cover plate adjacent said rod.

15. An improved slackless rail car connection wherein a gravity fed wedge, that functions to move to fill space created due to wear, is positioned fully within a car sill, said wedge having an upper broad edge and a narrow edge pointing downward between a sill pocket rear wall and a follower block engaged by a pivotable connector received in the car sill, said improvement comprising:

a rod for visually indicating wear of the wedge secured to the center of the upper broad edge of said wedge, said rod extending upwardly a distance above a top of said sill;

an opening in said top of said car sill, said opening being located forward of said pocket rear wall and above said wedge and having a dimension in excess of the cross section of said rod so as to freely receive said rod and permit horizontal movement of said rod longitudinal of said sill; and an apertured cover plate slidingly resting upon the said top of said sill to cover said opening, said cover plate reciprocally receiving said rod therethrough.

16. The structure of claim 15 including a reference post on said car sill adjacent said opening therein.

17. The structure of claim 15 including a reference post fastened upon said apertured cover plate.

18. The structure of claim 15 including a terminus end of said rod at a distance above said wedge in excess of the permissible wedge operating drop between said end wall and said follower block.

19. The structure of claim 18 wherein said terminus end is in the form of a bend.

* * * * *